US009709909B2

(12) United States Patent
Kikushima

(10) Patent No.: US 9,709,909 B2
(45) Date of Patent: Jul. 18, 2017

(54) ELECTROSTATIC LATENT IMAGE DEVELOPING TONER

(71) Applicant: KYOCERA Document Solutions Inc., Osaka (JP)

(72) Inventor: Seiji Kikushima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/966,529

(22) Filed: Dec. 11, 2015

(65) Prior Publication Data

US 2016/0170318 A1 Jun. 16, 2016

(30) Foreign Application Priority Data

Dec. 15, 2014 (JP) ..... 2014-253189

(51) Int. Cl.
*G03G 9/097* (2006.01)
*G03G 9/08* (2006.01)
*G03G 9/087* (2006.01)

(52) U.S. Cl.
CPC ..... *G03G 9/0819* (2013.01); *G03G 9/08755* (2013.01)

(58) Field of Classification Search
CPC ..... G03G 9/08704; G03G 9/08755
See application file for complete search history.

(56) References Cited

U.S. PATENT DOCUMENTS 6,682,866 B2 1/2004 Sugiyama et al.
6,800,412 B2 10/2004 Sugiyama et al.
7,846,634 B2 12/2010 Urabe et al.
2008/0131808 A1 6/2008 Urabe et al.
2013/0216944 A1* 8/2013 Shiba ..... G03G 9/0819 430/105

FOREIGN PATENT DOCUMENTS

JP 2003-131430 A 5/2003
JP 2008-139875 * 6/2008 ..... G03G 9/087
JP 2008139875 A 6/2008

OTHER PUBLICATIONS

Translation of JP 2008-139875 published Jun. 2008.*
An Office Action; "Notification of Reasons for Refusal" issued by the Japanese Patent Office on Jul. 12, 2016, which corresponds to Japanese Patent Application No. 2014-253189 and is related to U.S. Appl. No. 14/966,529; with English language translation.

* cited by examiner

*Primary Examiner* — Peter Vajda
(74) *Attorney, Agent, or Firm* — Studebaker & Brackett PC

(57) ABSTRACT

An electrostatic latent image developing toner includes toner particles containing a binder resin and at least one type of wax. A dispersed-phase diameter distribution of the wax has a peak at a dispersed-phase diameter in a range from 0.04 μm to 0.20 μm and a peak at a dispersed-phase diameter in a range from 1.0 μm to 5.0 μm. The wax includes first wax particles each having a dispersed-phase diameter in the range from 0.04 μm to 0.20 μm and second wax particles each having a dispersed-phase diameter in the range from 1.0 μm to 5.0 μm. A volume ratio of the first wax particles relative to the second wax particles is at least 0.5 and no greater than 1.5.

10 Claims, 2 Drawing Sheets

ELECTROSTATIC LATENT IMAGE DEVELOPING TONER

INCORPORATION BY REFERENCE

The present application claims priority under 35 U.S.C. §119 to Japanese Patent Application No. 2014-253189, filed on Dec. 15, 2014. The contents of this application are incorporated herein by reference in their entirety.

BACKGROUND

The present disclosure relates to an electrostatic latent image developing toner.

An electrostatic latent image developing toner that has excellent low-temperature fixability and thus is favorably fixable even when heating thereof by a fixing roller is kept at a minimal level, is preferable in terms of energy efficiency and device miniaturization. However, a toner having excellent low-temperature fixability typically includes a releasing agent, such as a wax, that has a low melting point. Therefore, when a toner having excellent low-temperature fixability is stored at high temperatures, aggregation of the toner tends to occur. Furthermore, a toner having excellent low-temperature fixability tends to suffer from a problem of high-temperature offset occurring due to the toner adhering to a heated fixing roller.

In order to combat the above problems, a dry toner has been considered. The dry toner contains at least a modified polyester (i) as a binder resin and a wax. In the toner, wax particles having a dispersed-phase diameter of 0.1 μm to 3 μm compose at least 70% by number of all wax particles.

SUMMARY

An electrostatic latent image developing toner according to the present disclosure includes toner particles containing a binder resin and at least one type of wax. A dispersed-phase diameter distribution of the wax has a peak at a dispersed-phase diameter in a range from 0.04 μm to 0.20 μm and a peak at a dispersed-phase diameter in a range from 1.0 μm to 5.0 μm. The wax includes first wax particles each having a dispersed-phase diameter in the range from 0.04 μm to 0.20 μm and second wax particles each having a dispersed-phase diameter in the range from 1.0 μm to 5.0 μm. A volume ratio of the first wax particles relative to the second wax particles is at least 0.5 and no greater than 1.5.

DETAILED DESCRIPTION

Figure 1:
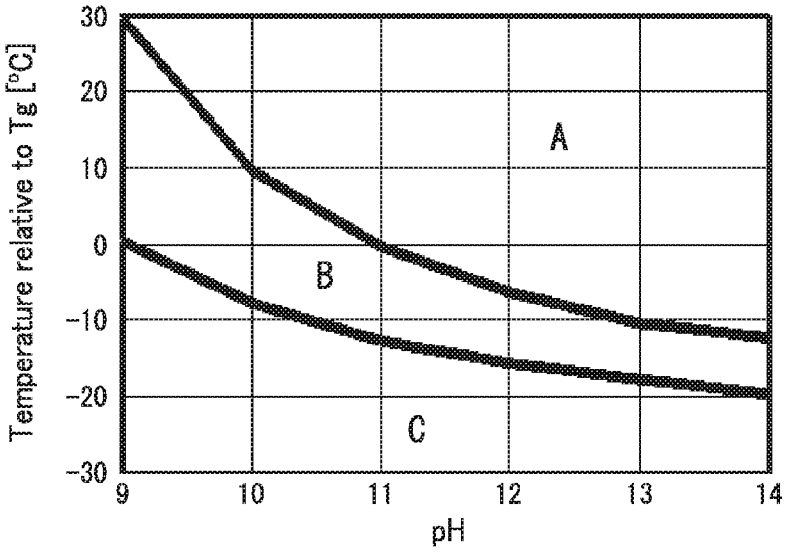
FIG. 1 illustrates preferable fine pulverization conditions in an embodiment.

The following explains an embodiment of the present disclosure in detail. However, the present disclosure is not in any way limited by the following embodiment and can be appropriately altered in implementation within the scope of the objective of the present disclosure. Although explanation is omitted where appropriate in order to avoid repetition, such omission does not limit the scope of the present disclosure.

An electrostatic latent image developing toner (referred to below as a toner) according to the present embodiment includes a large number of particles (referred to below as toner particles). The toner according to the present embodiment can be used, for example, in an electrophotographic apparatus. Unless otherwise stated, evaluation results (for example, values indicating shape and physical properties) for a powder (specific examples include toner cores, toner mother particles, external additive, and toner) are number averages of values measured for a suitable number of particles. In the present description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Furthermore, the term "(meth)acryl" is used as a generic term for both acryl and methacryl.

In an electrophotographic apparatus, an electrostatic latent image is developed using a developer containing toner. More specifically, toner from a developing device is caused to adhere to an electrostatic latent image formed on a photosensitive member. The adhered toner is transferred onto a recording medium such as paper and is then fixed to the recording medium by heat. The above process results in formation of a toner image on the recording medium. A full-color image can be obtained by, for example, superposing toner images formed using toners of four different colors: black, yellow, magenta, and cyan.

The following explains composition of toner particles according to the present embodiment.

The toner particles contain a binder resin and at least one type of wax, and may optionally contain internal additives as appropriate (for example, a colorant, a charge control agent, or a magnetic powder).

Surfaces of the toner particles (toner mother particles) may be treated with an external additive as necessary. The toner particles prior to treatment with the external additive may also be referred to as toner mother particles. The toner particles preferably each include a toner core and a shell layer that coats the surface of the toner core. A plurality of shell layers may be layered on the surface of the toner core.

[Wax]

The dispersed-phase diameter of the wax in the toner has two peaks (maximums). One of the peaks is in a range from 0.04 μm to 0.2 μm and the other of the peaks is in a range from 1.0 μm to 5.0 μm.

Wax particles having a dispersed-phase diameter in the range from 0.04 μm to 0.20 μm are referred to as first wax particles. Wax particles having a dispersed-phase diameter in the range from 1.0 μm to 5.0 μm are referred to as second wax particles. Inclusion of the first wax particles and the second wax particles in the toner particles tends to improve fixing offset resistance of the toner while also maintaining high-temperature preservability of the toner. The first wax particles are thought to contribute to widening of a low temperature end of a temperature region in which fixing offset of the toner does not occur, due to causing the toner particles to readily melt at low temperatures while maintaining high-temperature preservability of the toner. The second wax particles are thought to contribute to widening of a high temperature end of the temperature region in which fixing offset of the toner does not occur, due to raising releasability of the toner during fixing while maintaining high-temperature preservability of the toner. The first wax particles and the second wax particles preferably have the same composition.

A volume ratio of the first wax particles relative to the second wax particles is at least 0.5 and no greater than 1.5, and preferably at least 0.7 and no greater than 1.4.

The volume ratio of the wax particles can be measured by any generally used method. For example, a maximum diameter $D_1$ of a wax particle and a diameter $D_2$ perpendicular thereto can be measured by using commercially available image analysis software to analyze a transmission electron microscopy (TEM) image of a cross-section of the toner particle. The measured $D_1$ and $D_2$ are used to calculate an average dispersed-phase diameter D in accordance with equation (1) shown below. The calculated average dispersed-phase diameter D is used to calculate the volume of the wax particle in accordance with equation (2) shown below.

$$D=(D_1 \times D_2)^{1/2} \quad \text{Equation (1):}$$

$$\text{Volume of wax particle}=(4/3)\pi(D/2)^3 \quad \text{Equation (2):}$$

No particular limitations are placed on the wax. The wax expands upon heating. Examples of the wax include ester wax, polyethylene wax, polypropylene wax, fluororesin-based wax, Fischer-Tropsch wax, paraffin wax, and montan wax. Among the waxes listed above, ester wax is preferable. The ester wax may be a synthetic ester wax or a natural ester wax (for example, carnauba wax or rice wax). The ester wax is preferably a synthetic ester wax because appropriate choice of synthetic raw materials enables simple adjustment of a melting point ($Mp_r$) of the wax, as measured using a differential scanning calorie within a preferable range explained below. A combination of any two or more of the waxes listed above can be used.

No particular limitations are placed on the manufacturing method of the synthetic ester wax. A synthetic ester wax is typically manufactured by a chemical synthetic method. For example, the synthetic ester wax can be manufactured according to a commonly known method (reaction of an alcohol and a carboxylic acid or reaction of a carboxylic acid halide and an alcohol in the presence of an acid catalyst). The raw materials of the synthetic ester wax may be commercially available synthetic materials or may be materials derived from natural products such as long chain fatty acids manufactured from natural oils and fats.

[Binder Resin]

The binder resin preferably has an acid value of at least 20 mg KOH/g, and more preferably at least 25 mg KOH/g and no greater than 35 mg KOH/g.

The binder resin preferably has a softening point (Tm) of no greater than 100° C., and more preferably no greater than 90° C. The softening point (Tm) of the binder resin being no greater than 100° C. (more preferably no greater than 90° C.) enables sufficient fixability even during high speed fixing. The softening point (Tm) of the binder resin can be adjusted by combining a plurality of types of binder resins having different softening points (Tm).

The softening point (Tm) of the binder resin can be measured using a capillary rheometer (for example, CFT-500D produced by Shimadzu Corporation). For example, the softening point (Tm) of the binder resin can be read from an S-shaped curve (S-shaped curve of stroke/temperature) that is plotted by causing melt-flow under specific conditions of a measurement sample set in the capillary rheometer.

The binder resin for example preferably has an ester group, a hydroxyl group, an ether group, an acid group, a methyl group, a carboxyl group, or an amino group as a functional group. The binder resin preferably has a functional group such as a hydroxyl group, a carboxyl group, or an amino group in molecules of the binder resin, and more preferably has either or both of a hydroxyl group and a carboxyl group in molecules of the binder resin.

The binder resin is preferably a thermoplastic resin. Preferable examples of thermoplastic resins that can be used include styrene-based resins, acrylic acid-based resins, styrene-acrylic acid-based resins, polyethylene-based resins, polypropylene-based resins, vinyl chloride-based resins, polyester resins, polyamide-based resins, urethane-based resins, polyvinyl alcohol-based resins, vinyl ether-based resins, N-vinyl-based resins, and styrene-butadiene-based resins. Among the resins listed above, styrene-acrylic acid-based resins and polyester resins are excellent in terms of colorant dispersibility in the toner, toner chargeability, and toner fixability with respect to a recording medium.

(Styrene-Acrylic Acid-Based Resin)

The following explains a styrene-acrylic acid-based resin that can be used as the binder resin. The styrene-acrylic acid-based resin used as the binder resin is for example a copolymer of a styrene-based monomer and an acrylic acid-based monomer.

Examples of preferable styrene-based monomers include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Examples of preferable acrylic acid-based monomers include (meth)acrylic acid, alkyl(meth)acrylates, and hydroxyalkyl(meth)acrylates. Specific examples of preferable alkyl(meth)acrylates include methyl(meth)acrylate, ethyl(meth)acrylate, n-propyl(meth)acrylate, iso-propyl (meth)acrylate, n-butyl(meth)acrylate, iso-butyl (meth)acrylate, and 2-ethylhexyl(meth)acrylate. Specific examples of preferable hydroxyalkyl(meth)acrylates include-hydroxyethyl(meth)acrylate, 3-hydroxypropyl(meth)acrylate, 2-hydroxypropyl(meth)acrylate, and 4-hydroxybutyl (meth) acrylate.

A hydroxyl group can be introduced into the styrene-acrylic acid-based resin by using a monomer having a hydroxyl group (specific examples include p-hydroxystyrene, m-hydroxystyrene, and hydroxyalkyl(meth)acrylates) in preparation of the styrene-acrylic acid-based resin. The hydroxyl value of the prepared styrene-acrylic acid-based resin can for example be adjusted by appropriately adjusting the amount of the monomer having the hydroxyl group.

A carboxyl group can be introduced into the styrene-acrylic acid-based resin by using (meth)acrylic acid as a monomer in preparation of the styrene-acrylic acid-based resin. The acid value of the prepared styrene-acrylic acid-based resin can be adjusted by appropriately adjusting the amount of (meth)acrylic acid that is used.

The styrene-acrylic acid-based resin preferably has a number average molecular weight (Mn) of at least 2,000 and no greater than 3,000 in order to improve toner particle strength and toner fixability. The styrene-acrylic acid-based resin preferably has a molecular weight distribution a ratio Mw/Mn of mass average molecular weight (Mw) relative to number average molecular weight (Mn)) of at least 10 and no greater than 20. Mn and Mw of the binder resin can be measured by gel permeation chromatography.

(Polyester Resin)

The following explains a polyester resin that can be used as the binder resin. The polyester resin can be prepared, for example, through polymerization of a di-, tri-, together-hydric alcohol with a di-, tri-, or higher-basic carboxylic acid.

Examples of di-hydric alcohols that can be used to prepare the polyester resin include diols and bisphenols.

Specific examples of preferable diols include ethylene glycol, diethylene glycol, triethylene 1,2-propanediol, 1,3-propanediol, 1,4-butanediol, neopentyl 1,4-butenediol 1,5-pentanediol, 1,6-hexanediol, 1,4-cyclohexanedimethanol, dipropylene glycol, polyethylene glycol, polypropylene glycol, and polytetramethylene glycol.

Specific examples of preferable bisphenols include bisphenol A, hydrogenated bisphenol A, polyoxyethylene bisphenol A ether, and polyoxypropylene bisphenol A ether.

Specific examples of preferable tri- or higher-hydric alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, digylcerol, 2-methyl propanetriol, 2-methyl-1,2,4-butanetriol, tri methylol ethane, trimethylolpropane, and 1,3,5-trihydroxymethylbenzene.

Specific examples of preferable di-basic carboxylic acids include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, alkyl succinic acids, and alkenyl succinic acids. Preferable alkyl succinic acids include n-butylsuccinic acid, isobutylsuccinic acid, n-octylsuccinic acid, n-dodecylsuccinic acid, and isododecylsuccinic acid. Preferable alkenyl succinic acids include n-butenylsuccinic acid, isobutenylsuccinic acid, n-octenylsuccinic acid, n-dodecenylsuccinic acid, and isododecenylsuccinic acid.

Specific examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid. Alternatively, an ester-forming derivative (specific examples include acid halides, acid anhydrides, and lower alkyl esters) of any of the di-, tri-, or higher-basic carboxylic acids listed above may be used. In the present description, the term "lower alkyl" refers to an alkyl group having a carbon number of 1-6.

The acid value and the hydroxyl value of the polyester resin can be adjusted by appropriately adjusting the amount of the di-, tri-, or higher-hydric alcohol and the amount of the di-, tri-, or higher-basic carboxylic acid used in preparation of the polyester resin. An increase in the molecular weight of the polyester resin tends to cause a decrease in the acid value and the hydroxyl value of the polyester resin.

The polyester resin preferably has a number average molecular weight (Mn) of at least 1,000 and no greater than 2,000 in order to improve toner particle strength and toner fixability. The polyester resin preferably has a molecular weight distribution a ratio Mw/Mn of mass average molecular weight (Mw) relative to number average molecular weight (Mn)) of at least 1.5 and no greater than 21. Mn and Mw of the binder resin can be measured by gel permeation chromatography.

In a situation in which the toner particles each include a toner core and a shell layer, the glass transition point Tg of the binder resin contained in the toner cores is preferably no greater than a cure onset temperature of a thermosetting resin contained in the shell layers. Use of such a binder resin ensures sufficient fixability of the toner, even during high speed fixing. The thermosetting resin (in particular, a melamine-based resin) typically has a cure onset temperature of about 55° C. Therefore, Tg of the binder resin is preferably at least 20° C. and no greater than 60° C., more preferably at least 30° C. and no greater than 55° C., and particularly preferably at least 30° C. and no greater than 50° C. As a result of Tg of the binder resin being at least 20° C., the toner particles toner cores tend not to aggregate during formation of the shell layers.

Tg of the binder resin can be obtained from a point of change of specific heat on a heat absorption curve that is plotted for the binder resin using a differential scanning calorimeter.

[Colorant]

The colorant can for example be a commonly known pigment or dye that matches the color of the toner. The amount of the colorant is preferably at least 1 part by mass and no greater than 20 parts by mass relative to 100 parts by mass of the binder resin, and more preferably at least 3 parts by mass and no greater than 10 parts by mass.

(Black Colorant)

The toner particles according to the present embodiment may contain a black colorant. The black colorant is for example composed of carbon black. Alternatively, a black colorant that is adjusted to a black color using colorants such as a yellow colorant, a magenta colorant, and a cyan colorant can be used.

(Non-Black Colorants)

The toner particles according to the present embodiment may contain a non-black colorant such as a yellow colorant, a magenta colorant, or a cyan colorant.

Preferable examples of yellow colorants include condensed azo compounds, isoindolinone compounds, anthraquinone compounds, azo metal complexes, methine compounds, and arylamide compounds. Specific examples of preferable yellow colorants include CI. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Preferable magenta colorants include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of preferable magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Preferable examples of cyan colorants include copper phthalocyanine compounds, anthraquinone compounds, and basic dye lake compounds. Specific examples of preferable cyan colorants include C.I. Pigment Blue (1, 7, 15, 15:1, 15:2, 15:3, 15:4, 60, 62, and 66), Phthalocyanine Blue, C.I. Vat Blue, and C.I. Acid Blue.

[Charge Control Agent]

The following explains a charge control agent contained in the toner mother particles.

In the present embodiment, the toner mother particles may contain a charge control agent. The charge control agent may be used in order to improve charging stability or a charge rise characteristic of the toner, or to obtain a toner having excellent durability or stability. The charge rise characteristic of the toner is an indicator as to whether the toner can be charged to a specific charge level in a short period of time.

[Magnetic Powder]

The toner mother particles may contain a magnetic powder as necessary. Examples of preferable magnetic powders include ferrite, magnetite, iron, ferromagnetic metals (cobalt and nickel), alloys (alloys including either or both of iron and a ferromagnetic metal), compounds (compounds including either or both of iron and a ferromagnetic metal), ferromagnetic alloys (ferromagnetic alloys subjected to ferromagnetization such as heat treatment), and chromium dioxide.

The magnetic powder preferably has an average particle diameter of at least 0.1 μm and no greater than 1.0 μm, and more preferably at least 0.1 μm and no greater than 0.5 μm. As a result of the average particle diameter of the magnetic powder being in the aforementioned range, the magnetic powder tends to be easy to uniformly disperse in the binder resin.

In a situation in which the toner is used as a one-component developer, the amount of the magnetic powder is preferably at least 35 parts by mass and no greater than 60 parts by mass relative to 100 parts by mass of the toner overall, and more preferably at least 40 parts by mass and no greater than 60 parts by mass.

[Shell Layers]

In a situation in which shell layers are formed on the surfaces of the toner particles, the shell layers preferably contain a thermosetting resin and more preferably contain a binder resin including nitrogen atoms, or a derivative of such a binder resin, in order to improve strength, hardness, and cationic strength of the toner particles. Shell layers that include nitrogen atoms tend to be positively charged more readily. In order to increase cationic strength of the toner particles, the shell layers are preferably composed of at least 10% by mass of nitrogen atoms.

Preferable examples of the thermosetting resin contained in the shell layers include melamine resins, urea resins, sulfonamide resins, glyoxal resins, guanamine resins, aniline resins, and derivatives of the aforementioned resins. Preferable examples of a derivative of a melamine resin include methylol melamine. Preferable examples of a derivative of a guanamine resin include benzoguanamine, acetoguanamine, and spiroguanamine.

Other preferable examples of the thermosetting resin contained in the shell layers include polyimide resins having nitrogen atoms in a molecular backbone thereof, maleimide-based polymers, bismaleimide, amino-bismaleimide, and bismaleimide-triazine.

The thermosetting resin contained in the shell layers is particularly preferably a resin (referred to below as an aminoaldehyde resin) produced through polycondensation of an amino group-containing compound and an aldehyde (for example, formaldehyde), or a derivative of an aminoaldehyde resin. Note that a melamine resin is for example a polycondensate of melamine and formaldehyde. A urea resin is for example a polycondensate of urea and formaldehyde. A glyoxal resin is for example a polycondensate of formaldehyde and a reaction product of glyoxal and urea.

The shell layers preferably have a thickness of at least 1 nm and no greater a 20 nm, and more preferably at least 1 nm and no greater than 10 nm.

As a result of the thickness of the shell layers being no greater than 20 nm, the shell layers readily rupture upon application of heat or pressure during fixing of the toner to a recording medium. Therefore, softening or melting of the binder resin and the wax contained in the toner particles proceeds rapidly and the toner can be fixed to the recording medium at low temperatures. Furthermore, as a result of the thickness of the shell layers being no greater than 20 nm, it tends to be easy to appropriately perform image formation because chargeability of the shell layers is not too strong.

On the other hand, as a result of the thickness of the shell layers being at least 1 nm, the shell layers tend not to rupture due to an impact during transportation or the like because the toner particles have sufficient strength.

The thickness of the shell layers can be measured by analyzing TEM images of toner particle cross-sections using commercially available image analysis software (for example, WinROOF produced by Mitani Corporation).

The shell layers preferably have rupture points (parts having weak mechanical strength). The rupture points can be formed by generating localized defects in the shell layers. As a result of providing the rupture points in the shell layers, the shell layers tend to rupture more readily upon application of heat or pressure during fixing of the toner to the recording medium. Therefore, fixing can be performed at low temperatures even in a situation in which the shell layers contain a thermosetting resin. Any appropriate number of rupture points may be provided.

A positively chargeable charge control agent may be added to the shell layers in a situation in which chargeability of the shell layers is insufficient.

[External Additive]

The following explains an external additive contained in the toner particles according to the present embodiment. Note that the term "toner mother particles" is used below to refer to particles prior to treatment with the external additive.

The external additive is caused to adhere to the surfaces of the toner mother particles in order to improve fluidity and handleability of the toner particles. In order to improve fluidity and handleability of the toner particles, the amount of the external additive is preferably at least 0.5 parts by mass and no greater than 10 parts by mass relative to 100 parts by mass of the toner mother particles, and more preferably at least 2 parts by mass and no greater than 5 parts by mass.

Preferable examples of the external additive include silica and metal oxides such as alumina, titanium oxide, magnesium oxide, zinc oxide, strontium titanate, and barium titanate.

In order to improve fluidity and handleability of the toner particles, the external additive preferably has a particle diameter of at least 0.01 μm and no greater than 1.0 μm.

The following explains a method for manufacturing the toner according to the present embodiment.

The method for manufacturing the toner according to the present embodiment includes mixing, melting, kneading, and coarsely pulverizing raw materials including a binder resin and at least one type of wax to form a coarsely pulverized product (first process) and finely pulverizing the coarsely pulverized product under conditions in which pH and/or temperature is raised (second process).

As a result of the above toner manufacturing method, the wax has two peaks for dispersed-phase diameter. Therefore, a toner having excellent fixing offset resistance can be manufactured while maintaining high-temperature preservability of the toner.

The first process includes a mixing step, a melting step, a kneading step, and a coarse pulverization step. The mixing step involves mixing a binder resin, at least one type of wax, and other components as necessary to form a mixture. The melting step involves melting the resultant mixture. The kneading step involves kneading the melted product resulting from the melting step. The coarse pulverization step involves coarsely pulverizing the kneaded product resulting from the kneading step.

The second process involves finely pulverizing the pulverized product resulting from the first process under conditions in which pH and/or temperature is raised.

In the second process, the coarsely pulverized product resulting from the first process is preferably finely pulverized until the particle diameter of the pulverized product has a peak in a range from 1.0 μm to 5.0 μm and a peak in a range from 0.02 μm to 0.50 μm.

Pulverization in the second process is preferably performed for at least 30 minutes and no greater than 600 minutes, and more preferably at least 60 minutes and no greater than 300 minutes.

The second process is preferably carried out after aqueous medium dispersion of the coarsely pulverized product resulting from the first process. No particular limitations are placed on the dispersing step other than ensuring dispersion of the coarsely pulverized product in the aqueous medium.

The following explains different pulverization states arising from pulverization conditions (temperature and/or pH) with reference to FIG. 1. Under pulverization conditions indicated by region C in FIG. 1, it is difficult to finely pulverize the coarsely pulverized product resulting from the first process, even using a pulverizer.

In contrast, under pulverization conditions indicated by region A in FIG. 1, it is easy to effectively finely pulverize the coarsely pulverized product resulting from the first process using a pulverizer due to chemical effects. Effective fine pulverization of the coarsely pulverized product enables formation of particles having a particle diameter in range from 0.2 μm to 0.5 μm. For example, in a situation in which the coarsely pulverized product resulting from the first process is processed using a pulverizer at a relatively high temperature relative to Tg of the binder resin, effective fine pulverization tends to occur readily due to chemical effects. Furthermore, in a situation in which the coarsely pulverized product resulting from the first process is processed using a pulverizer at a high pH, effective fine pulverization tends to occur readily due to chemical effects.

In the present embodiment, the coarsely pulverized product resulting from the first process is effectively finely pulverized due to chemical effects under mild pulverization conditions in which pH and/or temperature is raised.

Note that when raising pH and/or temperature in the present embodiment, such raising is preferably carried out to reach conditions indicated by region B in FIG. 1. Specifically, in a situation in which the pH is raised to 9.0, the temperature is preferably no lower than the glass transition point (Tg) of the binder resin and no higher than 30° C. above the glass transition point (Tg) of the binder resin (i.e., Tg≤temperature≤Tg+30° C.). In a situation in which the pH is raised to 10.0, the temperature is preferably no lower than 8° C. below the glass transition point (Tg) of the binder resin and no higher than 10° C. above the glass transition point (Tg) of the binder resin (i.e., Tg−8° C. temperature≤Tg+10° C.). In a situation in which the pH is raised to 11.0, the temperature is preferably no lower than 14° C. below the glass transition point (Tg) of the binder resin and no higher than the glass transition point (Tg) of the binder resin (i.e., Tg−14° C.≤temperature≤Tg). In a situation in which the pH is raised to 12.0, the temperature is preferably no lower than 16° C. below the glass transition point (Tg) of the binder resin and no higher than 16° C. below the glass transition point (Tg) of the binder resin (i.e., Tg−16° C.≤temperature≤Tg−6° C.). In a situation in which the pH is raised to 13.0, the temperature is preferably no lower than 18° C. below the glass transition point (Tg) of the binder resin and no higher than 10° C. below the glass transition point (Tg) of the binder resin (i.e., Tg−18° C.≤temperature≤Tg−10° C.). In a situation in which the pH is raised to 14.0, the temperature is preferably no lower than 20° C. below the glass transition point (Tg) of the binder resin and no higher than 12° C. below the glass transition point (Tg) of the binder resin (i.e., Tg−20° C.≤temperature≤Tg−12° C.).

Atomization of particles over time through pulverization according to wet pulverization at raised pH and/or temperature is explained with reference to FIG. 2. In the second process, the coarsely pulverized product resulting from the first process is finely pulverized under conditions in which pH and/or temperature is raised. As time passes during pulverization, particles having a particle diameter in a range from 10 μm to 100 μm are pulverized to produce particles having a particle diameter in a range from 1.0 μm to 10 μm. In other words, as time passes during pulverization through pulverization times of 0 minutes (S1), 15 minutes (S2), 30 minutes (S3), and 45 minutes (S4), the number of particles having a particle diameter in the range from 10 μm to 100 μm decreases and the number of particles having a particle diameter in the range from 1.0 μm to 10 μm increases as shown in FIG. 2.

Figure 2:
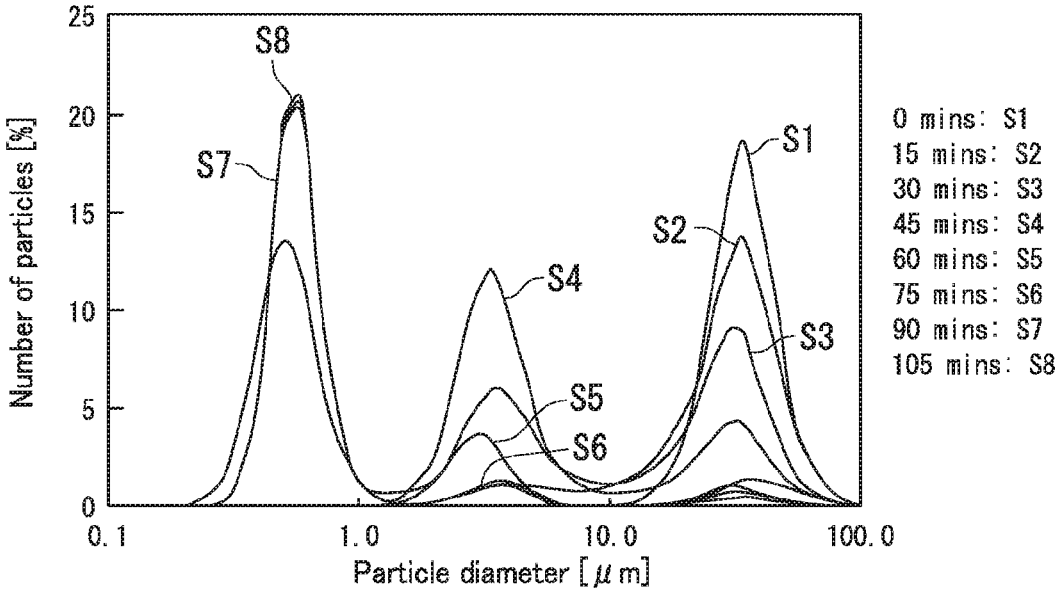
FIG. 2 illustrates atomization of particles over time during pulverization by a wet pulverization method.

Thereafter, as pulverization continues, particles having a particle diameter in the range from 1.0 μm to 10 μm are further pulverized to produce particles having a particle diameter in a range from 0.2 μm to 1.0 μm, in other words, as time passes during pulverization through pulverization times of 60 minutes (S5), 75 minutes (S6), 90 minutes (S7), and 105 minutes (S8), the number of particles having a particle diameter in the range from 1.0 μm to 10 μm decreases and the number of particles having a particle diameter in the range from 0.2 μm to 1.0 μm increases as shown in FIG. 2. Note that the horizontal axis in FIG. 2 has a logarithmic scale.

An aggregation step and a coalescence step may be carried out after pulverization of the particles. The aggregation step involves causing the pulverized particles to aggregate in an aqueous medium to form aggregated particles. The coalescence step involves causing components contained in the aggregated particles to coalesce in the aqueous medium to form toner particles.

EXAMPLES

The following provides more detailed explanation of the present disclosure through Examples. However, the present disclosure is not in any way limited by the following Examples.

[Silica Preparation]

First, 100 g of dimethylpolysiloxane and 100 g of 3-aminopropyltrimethoxysilane (products of Shin-Etsu Chemical Co., Ltd.) were dissolved in 200 g of toluene and diluted by a factor of 10. Next, the resultant diluted solution was dripped into 200 g of fumed silica AEROSIL 80 (product of Nippon Aerosil Co., Ltd.) while stirring and then was subjected to ultrasound irradiation and stirring for 30 minutes to produce a mixture. After heating of the mixture in a 150° C. thermostatic chamber, toluene was evaporated using a rotary evaporator to leave a solid. The resultant solid was dried using a reduced pressure dryer set to 50° C. until the mass of the solid no longer decreased. The solid was subjected to heat treatment at 200° C. for 3 hours in an electric furnace under a flow of nitrogen. A resultant powder was broken up by a jet mill and collected by a bag filter to obtain silica.

<Carrier Preparation>

After diluting 30 g of polyamide-imide resin with 2 L of water, 120 g of tetrafluroethylene-hexafluropropylene copolymer (FEP) and subsequently 3 g of silicon oxide were dispersed to produce a coating layer formation liquid. Coating was carried out by loading the coating layer formation liquid and 10 kg of uncoated ferrite EF-35B (product of Powdertech Co., Ltd., average particle diameter 35 μm) into a fluid bed coating device. Thereafter, baking was performed for 1 hour at 250° C. to obtain a carrier.

The following explains Examples of the present disclosure. Table 1 shows details of toners (electrostatic latent image developing toners) of Examples 1-6 and Comparative Examples 1 and 2.

TABLE 1

| | Toner composition | | | | | | | | | | |
|---|---|---|---|---|---|---|---|---|---|---|---|
| | Resin | | | Wax | | | | | | Device | |
| | Type | Glass transition point (Tg) (° C.) | Acid value (KOH · mg/g) | Type | Content (%) | Dispersed-phase diameter peaks (μm) | | Volume ratio (A/B) | pH adjuster | pH | Temperature (° C.) |
| Example 1 | A | 55.3 | 25.2 | A | 14.7 | 0.11 | 2.14 | 0.70 | TEA | 10.2 | 53 |
| Example 2 | B | 58.1 | 33.6 | A | 14.6 | 0.09 | 1.99 | 1.05 | TEA | 10.8 | 56 |
| Example 3 | A | 55.3 | 25.2 | B | 14.7 | 0.08 | 1.69 | 1.36 | TEA | 11.0 | 53 |
| Example 4 | A | 55.3 | 25.2 | A | 14.3 | 0.06 | 1.88 | 1.12 | NaOH | 11.9 | 53 |
| Example 5 | C | 56.7 | 17.6 | A | 12.6 | 0.16 | 2.57 | 0.53 | TEA | 10.3 | 55 |
| Example 6 | A | 55.3 | 25.2 | C | 12.8 | 0.13 | 3.42 | 0.52 | TEA | 10.4 | 53 |
| Comparative Example 1 | A | 55.3 | 25.2 | A | 14.5 | 0.31 | 2.43 | 0.42 | TEA | 9.6 | 53 |
| Comparative Example 2 | A | 55.3 | 25.2 | A | 13.3 | 0.10 | 1.87 | 1.69 | TEA | 12.1 | 53 |

Example 1

[Kneading and Coarse Pulverization Steps]

An FM mixer having a capacity of 20 L was used to mix 3,280 g of a polyester resin A (Mn: 1,882, Mw: 4,324, acid value: 252 mg KOH/g, Tm: 82.1° C., Tg: 55.3° C.), 328 g of a wax A (synthetic ester-based wax, melting point: 76° C., acid value: 0.1 mg KOH/g), and 382 g of a cyan pigment P.B. 15-3 (masterbatch, pigment ratio 50%, polyester resin A) for 3 minutes. Thereafter, melt-kneading was performed using a twin-screw extruder PCM-30 (product of Ikegai Corp.) at a cylinder temperature of 130° C., a screw rotation speed of 160 rpm, and a material loading rate of 4 kg/hour and cooling was performed using a drum flaker to yield kneaded chips. Next, coarse pulverization was performed using a Rotoplex W80 (product of Hosokawa Micron Corporation) and thereafter pulverization treatment was performed at 100 m/s and 7.2 kg/hour using a Millstardom MSD-LB (product of Tokyo Atomizer M.F.G. Co., Ltd.) to yield a coarsely pulverized toner product.

[Dispersion Step]

Next, 150 g of the coarsely pulverized toner product, 15 g of 10% E-0 (sodium dodecyl sulfate produced by Kao Corporation) aqueous solution, and 335 g of distilled water were loaded into a 2 L alumina ceramic vessel of a table-top sandmill (product of Hayashi Shoten) and were irradiated with ultrasound for 5 minutes at 50° C. to achieve sufficient dispersion. After addition of 1,500 g of zirconia beads having a diameter of 1 mm, further dispersion was performed by rotating three alumina ceramic disks for 180 minutes at 2,160 rpm (high-speed mode) and 53° C.

[Fine Pulverization Step]

After addition of 17.8 g of triethanolamine (TEA), fine pulverization treatment was performed for 60 minutes at 53° C. Thereafter, the zirconia beads were removed using a sieve having an opening size of 0.5 mm to yield a liquid of toner fine particles. The toner fine particles had a number median diameter of 287 nm and a volume median diameter of 443 nm as measured using a laser diffraction particle diameter distribution analyzer LA-850V2 (product of Horiba, Ltd.).

[Aggregation Step]

Next, a liquid dispersion of the toner fine particles was loaded into a 2 L stainless steel round-bottomed flask at 25° C. and, after addition of 500 g of distilled water, was stirred for 10 minutes at 100 rpm using a stirring blade. Subsequently, 51.2 g of magnesium chloride hexahydrate solution (solid content 50%) was added by dripping over 5 minutes and thereafter the mixed dispersion was heated at a rate of 0.2° C./minute to cause aggregation growth. Heating was continued up until approximately 65° C. at which a number average diameter as measured by a Multisizer III (product of Beckman Coulter, Inc.) was 4.5 μm. Next, heating was performed to 70° C. at a rate of 0.2° C./minute and with a raised stirring speed of 200 rpm. Stirring was continued at 70° C. for 120 minutes to cause coalescence of particles and yield toner particles of Example 1.

[Washing and Drying Steps]

Solid-liquid separation was performed through vacuum filtration of the toner particle dispersion using a Nutsche filter. A wet cake of toner particles resulting from filtration was re-dispersed in ion exchanged water and was subjected to vacuum filtration again using the Nutsche filter. Washing was repeated until the electrical conductivity of the filtrate was less than 3 μS/cm. The washed wet cake of toner was left for 72 hours in a vacuum oven DP63 (product of Yamato Scientific Co., Ltd.) at 40° C. and 1 kPa to yield a toner of Example 1. The toner of Example 1 had a median diameter (volume) of 5.45 μm and an average roundness of 0.852.

[External Addition Step]

The resultant toner was subjected to external addition. In the external addition, 2 g of silica was added relative to 100 g of the toner particles and an FM mixer (product of Nippon Coke & Engineering Co., Ltd.) having a capacity of 5 L was used to mix the silica and toner particles for 5 minutes. Thereafter, sifting was performed using a 300 mesh (opening 48 μm) sieve.

[Two-Component Developer Preparation]

Next, 300 g of a carrier and 30 g of the above toner were weighed into a plastic bottle having a capacity of 500 mL and were mixed for 30 minutes using a mixer (TURBULA (registered Japanese trademark) mixer T2F produced by Willy A. Bachofen AG) to prepare a developer of Example 1.

Example 2

A developer of Example 2 was prepared in the same way as in Example 1 in all aspects other than that a polyester resin B (Mn: 2,078, Mw: 5,127, acid value: 33.6 mg KOH/g, Tm: 84.5° C. Tg: 58.1° C.) was used instead of the polyester resin A.

Example 3

A developer of Example 3 was prepared in the same way as in Example 1 in all aspects other than that a wax B (carnauba wax, melting point: 82.1° C., acid value: 0.1 mg KOH/g) was used instead of the wax A.

Example 4

A developer of Example 4 was prepared in the same way as in Example 1 in all aspects other than that 24 g of 1N sodium hydroxide was used instead of 17.8 g of triethanol amine.

Example 5

A developer of Example 5 was prepared in the same way as in Example 1 in all aspects other than that a polyester resin C (Mn: 1,887, Mn: 5,754, acid value: 17.6 mg KOH/g, Tm: 83.2° C. Tg: 56.7° C.) was used instead of the polyester resin A.

Example 6

A developer of Example 6 was prepared in the same way as in Example 1 in all aspects other than that a wax C (paraffin wax, melting point: 75.5° C.) was used instead of the wax A.

Comparative Example 1

A developer of Comparative Example 1 was prepared in the same way as in Example 1 in all aspects other than that pulverization after addition of triethanolamine was performed for 20 minutes instead of 60 minutes.

Comparative Example 2

A developer of Comparative Example 2 was prepared in the same way as in Example 1 in all aspects other than that pulverization after addition of triethanolamine was performed for 2,180 minutes instead of 60 minutes.

Figure 3:
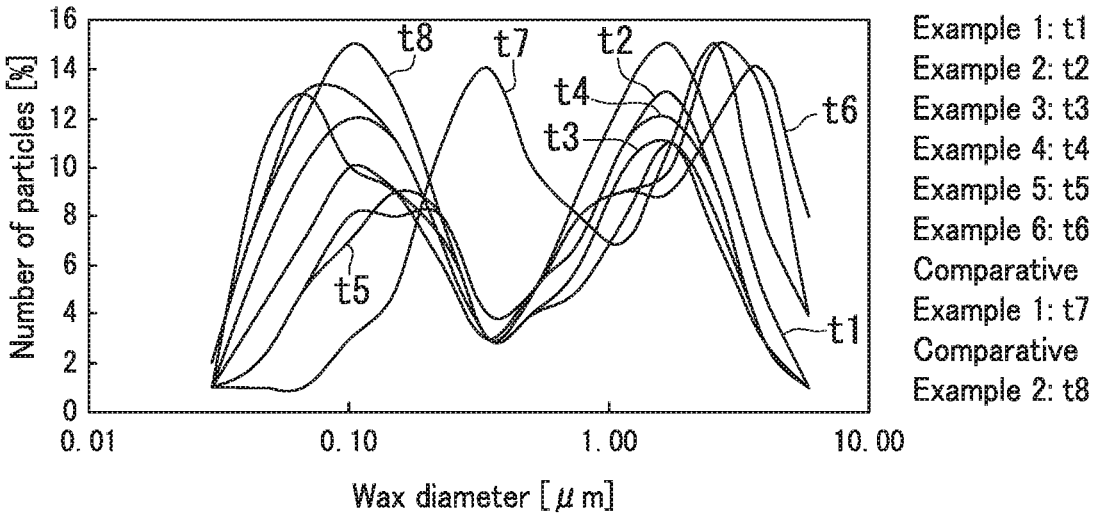
FIG. 3 illustrates a wax dispersed-phase diameter distribution for each of Examples 1-6 and Comparative Examples 1 and 2.

FIG. 3 illustrates a dispersed-phase diameter distribution of wax included in the toner of each of Examples 1-6 and Comparative Examples 1 and 2. For each of Examples 1-6 and Comparative Example 2, the wax contained in the toner had a peak at a dispersed-phase diameter in a range from 0.04 μm to 0.20 μm and a peak at a dispersed-phase diameter in a range from 1.0 μm to 5.0 μm. In contrast, the wax contained in the toner of Comparative Example 1 had a peak at a dispersed-phase diameter in the range from 1.0 μm to 5.0 μm, but did not have a peak at a dispersed-phase diameter in the range from 0.04 μm to 0.20 μm.

[Evaluation Methods]

The following describes evaluation methods and evaluation results. The results are shown in the tables.

[Wax Dispersed-Phase Diameter and Dispersed-Phase Diameter Distribution]

For each of Examples 1-6 and Comparative Examples 1 and 2, toner particles were dispersed in cold-setting epoxy resin and left to stand for 2 days at an ambient temperature of 40° C. to yield a hardened material. A flake of 100 nm in thickness was cut from the resultant hardened epoxy resin material as a measurement sample using a microtome (UC7k produced by Leica Microsystems). Next, the measurement sample was dyed using a 0.5% ruthenium tetraoxide aqueous solution. The dyed measurement sample was observed using a transmission electron microscope (TEM) and enlarged photographs of a toner particle cross-section were captured. The toner particle cross-section was arbitrarily selected. The enlarged photographs were captured at magnifications of ×5,000 and ×100,000. The obtained images were converted to two-value image data using image analysis software (WinROOF produced by Mitani Corporation). For each of 100 randomly selected wax particles, a maximum diameter $D_1$ of a cross-section of the wax particle and a diameter $D_2$ perpendicular to $D_1$ were measured. A dispersed-phase diameter D of the wax particle present in the toner particle was calculated from the measured diameters $D_1$ and $D_2$ using equation (3) shown below. A distribution of calculated dispersed-phase diameters D is shown in FIG. 3.

$$D=(D_1\times D_2)^{1/2} \quad \text{Equation (3):}$$

[Wax Particle Volume Ratio]

The volume of a wax particle was calculated from the dispersed-phase diameter D calculated for the wax particle as described above, using equation (4) shown below. Volumes of first wax particles and second wax particles were used to calculate a volume ratio of the first wax particles relative to the second wax particles.

$$\text{Volume of wax particle}=(4/3)\pi(D/2)^3 \quad \text{Equation (4):}$$

[Wax Content]

For each of Examples 1-6 and Comparative Examples 1 and 2, a heat absorption peak of the toner was measured using a differential scanning calorimeter (DSC-7020 produced by Hitachi High-Tech Science Corporation). The content of the wax in the toner was calculated by calculating an amount of heat absorption from the area of the heat absorption peak of the toner and dividing the aforementioned amount by an amount of heat absorption of the wax by itself obtained from a heat absorption peak of the wax by itself. Note that the heat absorption peak was calculated from a heat quantity difference between the measurement sample and a reference material. Measurement results for the wax content of the toners are shown in Table 1.

[Fixability and Offset Non-Occurrence Region]

A color multifunction peripheral (TASKalfa 5550ci produced by KYOCERA Document Solutions Inc.) was used as an evaluation apparatus. The developer prepared in each of Examples 1-6 and Comparative Examples 1 and 2 was loaded into a developing device of the evaluation apparatus. A fixing jig produced by the evaluation apparatus was used to fix a 0.4 mg/cm$^2$ unfixed toner image (patch) to evaluation paper (CC80 produced by Fuji Xerox Co., Ltd.) at a linear speed of 266 mm/s. Temperatures at which offset of the fixed image occurred were obtained. Offset non-occurrence temperature ranges such as shown in Table 2 were evaluated in accordance with the following standard.

Good: Offset non-occurrence temperature range of at least 40° C. in width

Poor: Offset non-occurrence temperature range of less than 40° C. in width

[High-Temperature Preservability]

For each of Examples 1-6 and Comparative Examples 1 and 2, 3 g of the toner was loaded into a plastic container having a capacity of 20 mL. The plastic container was set in a thermostatic chamber (convection oven produced by Sanyo Electric Co., Ltd.) at 50° C. or 55° C. for 3 hours. Thereafter, the toner in the plastic container set in the thermostatic chamber was left to stand for 3 hours at ambient conditions of 25° C. and 65% humidity. The plastic container was removed from the thermostatic chamber and the toner contained therein was loaded onto a sieve of known mass having an opening size of 45 μm. The 45 μm opening size sieve having the toner loaded thereon was attached to a powder tester (TYPE PT-E produced by Hosokawa Micron Corporation) and the toner was sifted for 30 seconds at level 5. Next, the amount of residual toner on the sieve was measured in order to measure the proportion of toner remaining on the sieve having the opening size of 45 μm.

Table 2 shows evaluation results of fixing offset resistance and high-temperature preservability for the toners of Examples 1-6 and Comparative Examples 1 and 2.

TABLE 2

| | Evaluation | | | | |
|---|---|---|---|---|---|
| | Fixing offset | | | High-temperature preservability Proportion remaining on 45 μm sieve | |
| | Low temperature end (° C.) | High temperature end (° C.) | Fixing range width (° C.) | 50° C. (%) | 55° C. (%) |
| Example 1 | 115.0 | 182.5 | 67.5 | 0.4 | 5.3 |
| Example 2 | 107.5 | 175.0 | 67.5 | 1.1 | 8.8 |
| Example 3 | 97.5 | 170.0 | 72.5 | 0.7 | 5.6 |
| Example 4 | 122.5 | 187.5 | 65.0 | 0.2 | 3.1 |
| Example 5 | 117.5 | 167.5 | 50.0 | 0.8 | 7.6 |
| Example 6 | 117.5 | 170.0 | 52.5 | 0.2 | 5.9 |
| Comparative Example 1 | 127.5 | 175.0 | 47.5 | 1.2 | 9.5 |
| Comparative Example 2 | 100.0 | 167.5 | 67.5 | 15.7 | 75.3 |

The toners of Examples 1-6 could be fixed at low temperatures, had excellent fixing offset resistance as indicated by a wide fixing range, and had excellent high-temperature preservability. In contrast, the toner of Comparative Example 1 could not be fixed at low temperatures and had poor fixing offset resistance as indicated by a narrow fixing range. Furthermore, although the toner of Comparative Example 2 could be fixed at low temperatures and had a wide fixing range, the toner had poor high-temperature preservability.

What is claimed is:

1. An electrostatic latent image developing toner comprising toner particles containing a binder resin and at least one type of wax, wherein a dispersed-phase diameter distribution of the wax has a peak at a dispersed-phase diameter in a range from 0.04 μm to 0.20 μm and a peak at a dispersed-phase diameter in a range from 1.0 μm to 5.0 μm, the wax includes:

first wax particles each having a dispersed-phase diameter in the range from 0.04 μm to 0.20 μm; and second wax particles each having a dispersed-phase diameter in the range from 1.0 μm to 5.0 μm, and a volume ratio of the first wax particles relative to the second wax particles is at least 0.5 and no greater than 1.5.

2. The electrostatic latent image developing toner according to claim 1, wherein the binder resin has an acid value of at least 20 mg KOH/g.

3. The electrostatic latent image developing toner according to claim 1, wherein the binder resin includes a polyester resin.

4. The electrostatic latent image developing toner according to claim 1, wherein the binder resin has a glass transition point of at least 20° C. and no greater than 60° C.

5. The electrostatic latent image developing toner according to claim 1, wherein the wax has a melting point of at least 75.5° C. and no greater than 82.1° C.

6. The electrostatic latent image developing toner according to claim 1, wherein the binder resin has a softening point (Tm) of no greater than 100° C.

7. The electrostatic latent image developing toner according to claim 1, wherein a content of the wax in the toner is at least 12.6% and no greater than 14.7%.

8. The electrostatic latent image developing toner according to claim 1, wherein the binder resin has an acid value of at least 20 mg KOH/g and no greater than 35 mg KOH/g.

9. The electrostatic latent image developing toner according to claim 1, wherein the binder resin has a molecular weight distribution (Mw/Mn) of at least 1.5 and no greater than 21, the molecular weight distribution (Mw/Mn) expressing a ratio of a mass average molecular weight (Mw) of the binder resin relative to a number average molecular weight (Mn) of the binder resin.

10. The electrostatic latent image developing toner according to claim 1, wherein the peak at the dispersed-phase diameter of the wax in a range from 0.04 μm to 0.20 μm is in at least 0.06 μm and no greater than 0.16 μm, and the peak at the dispersed-phase diameter of the wax in a range from 1.0 μm to 5.0 μm is in at least 1.69 μm and no greater than 3.42 μm.

* * * * *